US005827329A

United States Patent [19]

Champeau

[11] Patent Number: 5,827,329

[45] Date of Patent: Oct. 27, 1998

[54] METHOD FOR CLEANING IN A LIQUID MEDIUM FABRICS OF CLOTHES, AND PLANT FOR IMPLEMENTING SUCH METHOD

[75] Inventor: André Champeau, Paris, France

[73] Assignee: I.L.S.A., S.P.A., Italy

[21] Appl. No.: 776,447

[22] PCT Filed: Jul. 20, 1995

[86] PCT No.: PCT/FR95/00976

§ 371 Date: Jan. 24, 1997

§ 102(e) Date: Jan. 24, 1997

[87] PCT Pub. No.: WO96/05352

PCT Pub. Date: Feb. 22, 1996

[30] Foreign Application Priority Data

Aug. 9, 1994 [FR] France ..... 94 09840

[51] Int. Cl.[6] ..... D06F 43/08

[52] U.S. Cl. ..... 8/142; 8/137; 8/149.1; 68/12.08; 68/12.09

[58] Field of Search ..... 8/137, 142, 149.1; 68/12.08, 12.09, 139; 34/406, 411, 412, 130, 132, 139

[56] References Cited

U.S. PATENT DOCUMENTS 1,843,657 2/1932 Welles et al. .

FOREIGN PATENT DOCUMENTS 1 143 923 10/1957 France .
1 338 398 10/1963 France .
88 834 2/1967 France .
2 696 480 4/1994 France .
2696480 4/1994 France .
38 24 046 2/1990 Germany .

*Primary Examiner*—Alan Diamond
*Attorney, Agent, or Firm*—Michaelson & Wallace; Peter L. Michaelson; Edward M. Fink

[57] ABSTRACT

A method and apparatus are described for cleaning fabrics and clothes in a liquid medium wherein a vacuum drying step is effected at a pressure ranging from $1.5\times10^3$ Pa to $15\times10^3$ Pa in the presence of steam which is injected into the drying process at a pressure between $0.8\times10^4$ to $8\times10^4$ Pa and which is used as a carrier for removing the cleaning liquid.

15 Claims, 3 Drawing Sheets

METHOD FOR CLEANING IN A LIQUID MEDIUM FABRICS OF CLOTHES, AND PLANT FOR IMPLEMENTING SUCH METHOD

This application is a 371 of PCT/FR95/00976 filed Jul. 20, 1995.

The invention concerns a method for cleaning in a liquid medium fabrics or clothes, and plant for implementing such method.

In cleaning techniques in a liquid medium currently used, the articles to be cleaned are first washed by bringing them into contact with the liquid, which is constantly cleaned, by agitation within a rotating drum or by spraying the liquid onto the moving articles.

In a second phase, a greater or lesser proportion of the liquid is mechanically removed by various spinning or pressing techniques.

Finally, the remainder of the liquid must be extracted from the articles during an operation known as drying.

The latter must be continued to the point of total elimination of the liquid, especially in the case of organic solvents which are often toxic, even in very small amounts.

Most cleaning machines using a solvent employ an air circulation closed circuit drying method.

The heat needed to evaporate the solvent remaining after mechanical spinning is introduced by the circulating air. The entrained solvent is then condensed in the cold part of the circuit.

The closer together the evaporation and cooling temperatures, the more similar are the heating and cooling requirements.

Modern cleaning machines are fitted with a heat pump system that recovers approximately 50% of the necessary thermal energy.

Also known in themselves are methods of cleaning clothes using solvents in which the drying step is carried out in a vacuum. This is the case in particular in the methods described in patent FR-A-1338 398 and its patent of addition FR-E-88 834. In the method as described in the patent of addition, before and/or during the application of the vacuum, application of heated vapour or heated or superheated steam, in particular vapours of solvents, to transfer the heat to the residual solvent to evaporate it is recommended. Nevertheless, this document does not contain any suggestion of applying vapour produced at a low pressure, in particular superheated steam, throughout the drying stage.

Tests conducted by the inventor of the present application have clearly shown that the use of superheated steam as soon as the vacuum is applied greatly contributes to the acceleration of the heat exchanges needed for drying.

French patent FR-2 696 480 also describes an extraction vacuum drying method, called an "azeotropic" method, using expanded steam.

This method has a certain number of advantages over the conventional methods: fast drying, complete elimination of solvent, quality of cleaning, absence of electrostatic charges.

In the current state of the art, the machines used are relatively well suited to the use of solvents such as perchlorethylene.

Nevertheless, the toxicity of this solvent is such that it is likely to be banned in the medium term if it were not possible to reduce emissions effectively to around zero, which conventional air drying machines are not really capable of.

The latter machines also represent a compromise in terms of specific treatment capacities.

In these machines, twice the "container" capacity is needed for drying as for washing. The drum capacity adopted is therefore a compromise between these two values.

Moreover, the use of hydrocarbon solvents such as undecane in conventional type machines raises safety problems that are alleviated by operating in an inert gas, produced by a relatively costly nitrogen generator.

Furthermore, because of the low volatility of the solvent, the drying time is practically doubled (compared to the chlorinated solvent).

Moreover, with the use of low volatility solvents from the hydrocarbon family, as currently envisaged, methods utilising a vacuum drying stage consume a great deal of energy, like other, more conventional methods.

The new method and the means for implementing it that are the subject matter of the present invention provide a response to the inadequacies and to the imperfections of the current technique and to the requirements expressed by users.

Accordingly, to be more precise, the method of the invention, including a drying phase in a vacuum carried out at a pressure between $1.5\times10^3$ and $15\times10^3$ Pa in the presence of vapour adapted to serve as a carrier for elimination of said liquid and injected into the drying enclosure is characterised in that said vapour is steam injected as soon as the vacuum reaches a value between 1.5 and $15\times10^3$ Pa from a source at a pressure between $0.8\times10^4$ and $8\times10^4$ Pa.

The injection of low-pressure steam, in particular low-pressure superheated steam, as soon as the vacuum is applied to the drying enclosure expels all of the air contained in the machine. The drying operation carried out in accordance with the invention uses a non-azeotropic extraction process, i.e. it is possible to vary the flowrate of the injected vapour to obtain a given result, because the system is bivariant, whereas in a azeotropic process, which is inherently monovariant, the ratio of the quantities of steam and solvent is determined by the pressure.

The advantage of the method of the invention, which yields a non-azeotropic solvent extraction system, is enhanced when undecane hydrocarbon solvents are used, since the use of a solvent of this kind would lead to the consumption of much greater quantities of vapour in the case of an azeotropic system: 5 kg of vapour would be required for each 1 kg of solvent in a system of this kind, whereas the method of the invention limits the consumption of vapour to at most 1.1 kg for each 1 kg of solvent, i.e. one fifth the amount.

Another advantage of the method of the invention is that it reduces the solvent evaporation temperature. At a pressure of $3\times10^3$ Pa, it is only 14° C. with perchlorethylene, whereas it is around 28° C. in the methods described in patent FR-E-88 834 cited hereinabove.

As a result, in the method of the invention, the evaporation gradient, i.e. the difference between the temperature of the environment of the clothes inside the basket of the machine and that of the solvent in the clothes, is practically doubled, which substantially enhances the efficiency of drying.

Moreover, if the use of hydrocarbon solvents as substitutes for chlorinated solvents is envisaged, the elimination of the air by scavenging with vapour constitutes a second particularly important advantage of the method of the invention, as it eliminates the need for an inert gas generator such as is currently used in conventional machines in particular and which represents an additional installation cost of at least 20%.

Another advantage of using superheated steam on application of the vacuum is that it also contributes to acceleration of the heat exchanges necessary for drying.

This heat carrier is very much more efficient than the air or the solvents used in the method described in patent FR-E-88 834 cited hereinabove in particular.

The invention also concerns plant for implementing the above method comprising a rotary drum and means for establishing a vacuum of between $1.5\times10^3$ and $15\times10^3$ Pa in said enclosure during the drying step and means for supplying and injecting vapour into said enclosure, characterised by means for supplying and injecting steam from a source at a pressure between $0.8\times10^4$ and $8\times10^4$ Pa.

The following description, given with particular reference to FIGS. 1 through 3, shows clearly the advantages of the method of the invention.

In a first aspect, the invention concerns a new method of vacuum drying.

The invention concerns a method for cleaning in a liquid medium fabrics or clothes including a vacuum stage carried out at a pressure between $1.5\times10^3$ and $15\times10^3$ Pa in the presence of steam adapted to serve as a carrier for elimination of said liquid and injected from a source at a pressure between $0.8\times10^4$ and $8\times10^4$ Pa, preferably between 4 and $6\times10^4$ Pa.

This drying stage is advantageously carried out at a temperature between 30° and 55° C., preferably between 35° and 45° C.

This temperature is advantageously obtained by heating the wall of the enclosure in which drying is carried out to a temperature between 40° and 75° C., so assuring direct transfer of heat.

The steam is preferably superheated to a temperature between 80° and 150° C. before it is injected.

The steam is introduced from the start of the drying phase and for the entire duration of this step. It is therefore introduced as soon as the vacuum reaches a value between 1.5 and $15\times10^3$ Pa.

The temperature and the pressure of the injected vapour yield an essentially non-azeotropic solvent extraction system, unlike the system described in patent FR-2 696 480. It is a bivariant system that optimises the solvent extraction conditions.

A particularly advantageous variant of the method of the invention further utilises a heat pump system in which high performance is obtained by virtue of the small temperature difference between the hot and cold parts, which may be between 50° and 60° C. The practical coefficient of performance is thereby approximately 3.

This device supplies all heating and cooling needs.

Accordingly, a heat generator supplies the low-pressure vapour, at a pressure between $0.8\times10^4$ and $8\times10^4$ Pa and at the same time the heating water at a temperature in the order of 40° to 75° C., advantageously 40° to 55° C., as required.

The above features yield:

1) A high extraction gradient, accelerating the process, in particular in the case of "heavy" solvents such as undecane, for example.

Figure 1:
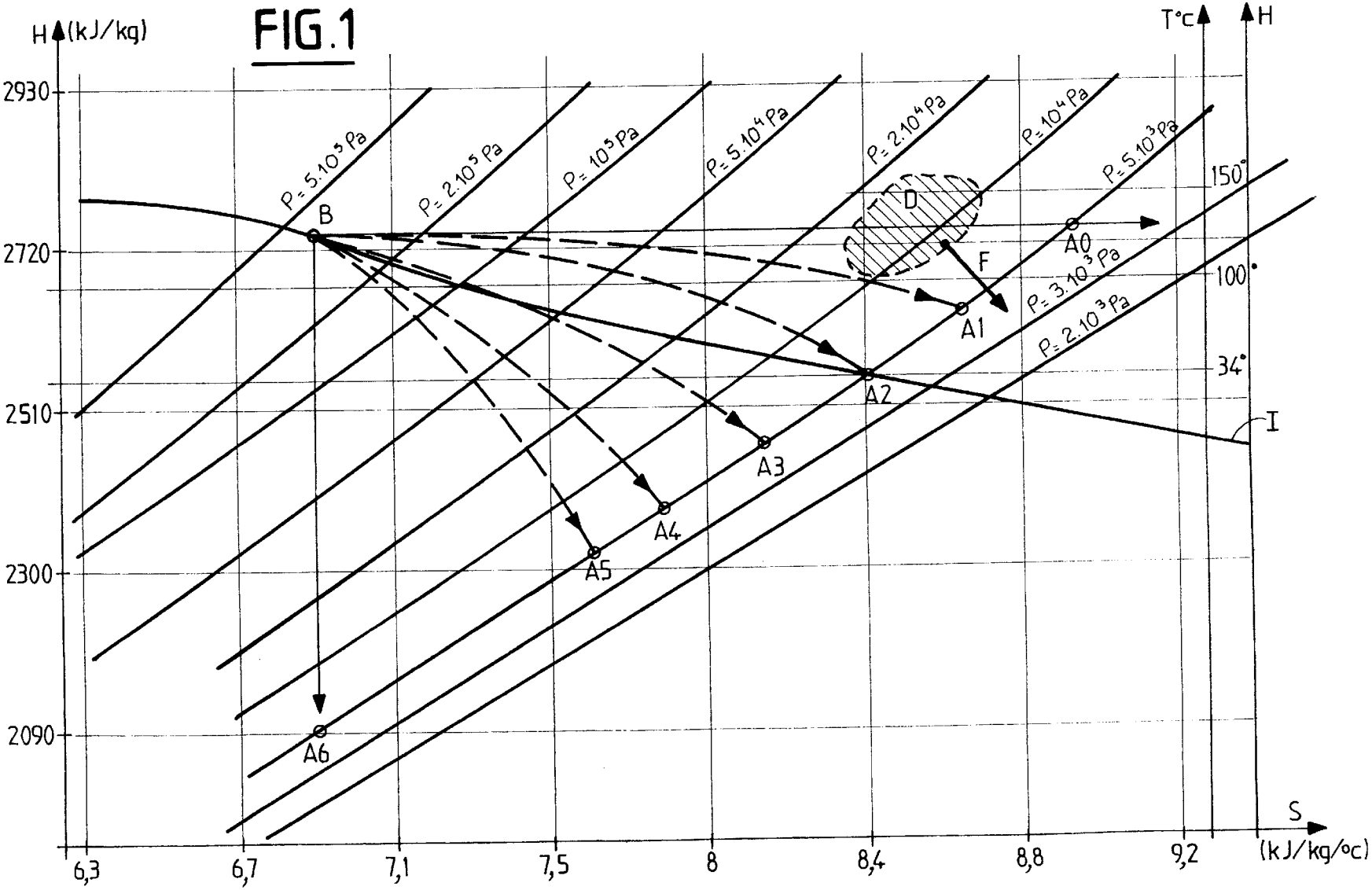
FIG. 1: the MOLLIER diagram showing the enthalpy (H) of the system as a function of its entropy (S)

2) The use of low-pressure steam for scavenging avoids the drawbacks inherent to the use of vapour at 3 to $5\times10^5$ Pa supplied by conventional generators, expansion of which in the machine is not free of the risk of condensation, as shown by the MOLLIER diagram reproduced in FIG. 1 and well known to the person skilled in the art. This diagram shows that, in the conditions of the present invention, the working conditions of the scavenging vapour are greatly above the saturation curve, which is not the case when the vapour is expanded to 3 to $5\times10^5$ Pa inside the machine.

3) Reduced energy consumption compared to conventional machines with heat pumps, the saving being at least 30%.

4) No consumption of water.

5) Extremely low residual emission of solvent. The concentration of solvent in the machine when opened is less than 25 ppm, whereas the best machines conforming to the current standards feature concentrations at least ten times greater.

The MOLLIER diagram reproduced in FIG. 1 shows the benefit of injecting steam from a source of superheated steam, for example low-pressure steam at 150° C., represented by the shaded area D in the graph. The expansion resulting from the introduction of this steam into an enclosure at a lower pressure is shown by the arrow F. The risk of condensation, shown by the part of the diagram below the saturation curve (I), is practically zero.

On the other hand, the expansion of a vapour at the same temperature of 150° C. but from a pressure of $5\times10^5$ Pa, represents a high risk of condensation. Such expansion follows paths between an isentropic expansion (vertical line $BA_6$) and an isenthalpic expansion (horizontal line $BA_0$). The path is more or less inclined between $BA_6$ and $BA_0$, according to the work done by the vapour as it expands.

FIG. 1 shows, by way of example, intermediate expansion paths of this kind represented by the curves $BA_2$, $BA_3$, $BA_4$, $BA_5$. Only expansion along $BA_1$, with practically no "external" work, is free of condensation.

Another advantage of the drying method of the invention is that, although it is perfectly suited to cleaning methods in a liquid medium using organic solvents, and more especially chlorinated solvents, in particular perchlorethylene, as is most usual at present, it can also be used with hydrocarbon type solvents, in particular saturated or unsaturated $C_8$ through $C_{12}$ hydrocarbons, for example undecane, or ester or alcohol type derivatives of these hydrocarbons, possibly mixed with water, and suitable for cleaning.

This represents a particular advantage of the invention since this type of solvent may in the future replace the chlorinated solvents widely used at present.

The plant includes a sealed drying enclosure comprising a rotary drum and means for producing a vacuum of between $1.5\times10^3$ and $15\times10^3$ Pa in said enclosure during the drying step and means for supplying vapour and injecting it into said enclosure.

The means for establishing said vacuum advantageously comprise a vacuum pump and an air ejector on the suction device of said vacuum pump.

The two-stage water ring vacuum pumps used until now can only with difficulty produce vacuums of less than $4\times10^3$ Pa, and this on condition that the water ring is cooled to 15° C. or below. Moreover, at around this pressure, it is difficult to avoid cavitation due to evaporation of water within the pump, which rapidly damages it.

Accordingly, in accordance with the invention, a water ring pump is advantageously used. Nevertheless, an air ejector is disposed at the inlet of the vacuum pump, it is fed with air at atmospheric pressure from the outlet of the pump, recycling occurs, and it is the ejector that extracts directly from the tank and produces a vacuum that is advantageously in the order of 1 300 Pa, which is unobtainable with the pump alone. The result is spectacular since the solvent extraction conditions are then at a much lower temperature level. The use of this new vacuum device enables the extraction of solvent vapour at an equilibrium temperature in the order of 15° C., rather than a temperature of at least 30° C. with the pump alone. The temperature gradient, governing the evaporation of the solvent, is practically doubled, from 15° C. to 30° C.

Another advantage is the avoidance of any risk of cavitation in the vacuum pump.

Accordingly, in plant of the present invention, as in that described in patent FR-2 696 480, the water ring pump operates in a closed circuit but the hardness of the vacuum may be substantially improved by the addition of an air ejector disposed on the suction circuit of the vacuum pump.

Nevertheless, in machines of low capacity, the vacuum pump could be replaced by a device including a water ejector.

In an advantageous variant of the invention the plant also includes means for heating the rotary drum.

These means may comprise means for directly or indirectly heating the drum. Direct heating is preferable.

Direct heating may be achieved by means of a hot water circuit at 40° to 75° C. constituting the cylindrical surface of the drum, using a 20 mm diameter stainless steel tube coil with the turns spaced by 3 mm, for example. With a device of this kind, or any equivalent device, the transfer of heat is much more efficient and the thermal efficiency is trebled.

The low-pressure steam is generally superheated before it is injected into the drying enclosure.

The plant for implementing the method of the invention also includes heating and cooling means using quantities of heat that are much more similar at lower process pressures.

Accordingly, a heat pump device can be used with exceptional efficiency.

It is possible to operate between temperatures of 60° and 5° C. The resulting theoretical performance coefficient is 333/55=6.05.

A practical coefficient of 3 can therefore be expected, meaning that with a 6 kW compressor it is possible to generate as much steam as with an 18 kW boiler.

However, this system also provides a cooling capability equivalent to around 4° to 12° C., preferably 5° to 8° C.

Figure 2:
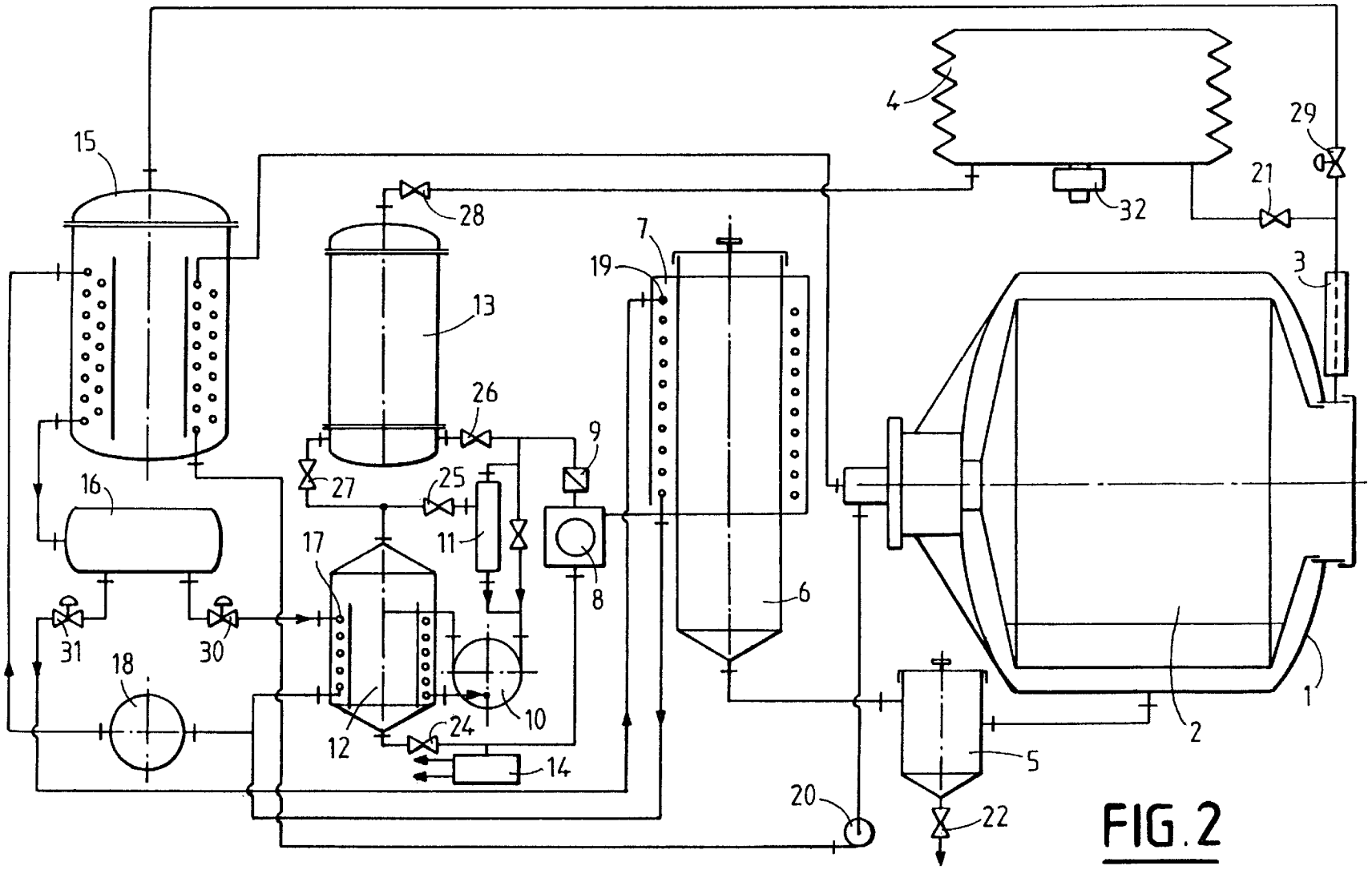
FIG. 2: improved plant for implementing the method of the invention.

The method and the plant of the invention are illustrated by the following description of one particular embodiment of the invention given with reference to FIG. 2 which corresponds to a particularly beneficial variant of the invention using a heat pump system. A simplified installation that does not feature the improvement consisting in the heat pump is described later, with reference to FIG. 3.

FIG. 2 is a diagram of plant for implementing the invention incorporating a heat pump system.

Certain parts concerning equipment units common to all cleaning machines, in particular solvent storage tanks and control equipment, have been omitted in order to simplify the diagram.

The plant shown in FIG. 2 comprises the following equipment units:

the machine proper, comprising a sealed enclosure 1 having a loading door and a rotary drum 2 provided with a heating device. This part constitutes the hot part of the device.

Following the paths of the liquid and gaseous effluents, there are encountered in succession:

a liquid filter 5 for elimination of solid particles (pins, buttons, etc), a gas and vapour filter 6, a vapour condenser 7, a receptacle 8 in which the condensates are recovered.

The components 7 and 8 of the plant constitute the cold part of the device.

a vacuum device for extracting the uncondensed vapours and the gases, comprising:

a vacuum pump 10, a gas ejector 11, a separator/cooler 17.

The recovered liquids are treated in a settling tank 14.

A heat pump system provides the heating and cooling needs of the plant.

It essentially comprises:

a freon compressor 18, a heat generator 15 supplying low-pressure vapour injected into the machine at 0.8 to $8\times10^4$ Pa, with practically no expansion, via the heater 3, hot water at 40° to 75° C., circulated by the pump 20 and fed into the rotary drum through the central transmission shaft, the cooling requirements are provided separately to the separator 12 and the condenser 7 by the respective evaporators 17 and 19, each provided with its own expander, connected to the reserve tank 16.

The plant enables the condensates to be recycled and the condensed water collected at 14 and 12 can therefore be used as feed water to the steam generator 15. This generator is fed with water in the form of the condensates produced during the drying step, with an external top-up if necessary, with the result that there is no rejection of liquid effluent to the exterior.

In a different embodiment, the two evaporators 17 and 19 are replaced with a single evaporator to cool the water which is then circulated to cool the condenser 7 and the separator 12.

The gases that cannot be condensed are passed through an activated carbon absorber 13.

They are fed into the variable volume tank 4 and are reintroduced into the machine at the end of the cycle to restore atmospheric pressure and to enable the door to be opened.

The foregoing description of the main equipment units of the plant shown in the FIG. 2 diagram is complemented hereinafter by that of the operation of the plant, with reference to the FIG. 2 diagram.

The washing phase is effected by circulation of solvent sprayed directly into the drum 2 from the front face of 1, as the drum rotates to and fro.

The solvent flows through the filter 5 and the valve 22. It is taken up by a circulation pump and fed into a cleaning filter, not shown, before it is recycled.

Washing is often complemented by a rinsing operation using the solvent that has just been distilled.

A greater or lesser proportion of the solvent retained by the clothes is mechanically extracted by spinning. The drum is rotated at a speed that can be adjusted to suit the nature of the articles being treated by a drive device incorporating a motor and an electronic variable speed drive.

The final drying phase employs the simultaneous means for its implementation inside the drum, the speed of which is reduced to approximately that used for washing.

Just before the end of spinning, the heat pump system is started up so that the required heating and cooling can be obtained quickly.

The vacuum device, essentially the pump 10, is also started up. It is then necessary to isolate the tank 1 from the exterior, which entails closing the valves 21, 22, 24. The valve 26 is closed and the valves 25, 27 and 28 are open.

A vacuum is therefore rapidly established in the equipment units on the upstream side of the pump 10, i.e. the parts 1, 5, 6, 7 and 8 of the system.

The solvent contained in the clothes begins to evaporate due to the simultaneous effect of the vacuum and the input of heat direct to the surface of the drum 2. This phenomenon is then accelerated by starting the injection of vapour into the machine through the heater 3 under the control of the automatic valve 29. The starting of injection of vapour is adjusted to obtain a pressure between 1.5 and $15\times10^3$ Pa, as appropriate, the flowrate being adjusted by a calibrated orifice or any equivalent device.

The acceleration of extraction obtained in this way is the result of modification of the vapour equilibrium conditions and of mechanical effects accompanied by thermal heating at the margins of azeotropic conditions.

The vapour from 1 and 2 is for the most part (around 90%) stopped by the condenser 7. The cooling temperature depends on the adjustment of the expander 31 feeding the evaporator 19.

The condensate receiving tank 8 is provided with an indicator lamp so that the progress of drying can be monitored.

In the device shown, the pump 10 is a water ring pump operating in a closed circuit provided with a cyclone type fluid separator 12 cooled by the evaporator 17 fed from the expander 32.

A certain quantity of solvent is stopped in the separator 12 and is evacuated at the end of the operation to the settling tank 14.

The solvent is finally returned to the storage tanks of the machine, which are not shown.

The end of drying, visually indicated by the indicator lamp 8, is also registered at this point and can command stopping injection of vapour and then stopping the vacuum pump.

The variable volume tank 4 has been filled during the drying phase with air extracted from 1 in particular, excess gas caused by leaks, for example, being able to escape via the valve 32.

When drying is finished, opening the valve 21 between 4 and 1 re-establishes atmospheric pressure in the machine so that it can be opened to take out the clothes, representing the end of the cycle.

The sequence of operations just described illustrates one implementation of the method.

Many variants are possible within the spirit of the method.

These operations can be controlled by a programmer allowing various adjustments to suit the differing needs of the user.

A small quantity of solvent (less than 100 g per cycle) is retained by the activated carbon absorber 13. The solvent contained in the absorber can be eliminated either after each cycle or after at least 20 cycles, using techniques and procedures familiar to the person skilled in the art that do not require to be specifically described here.

The method and its implementation just described apply without significant change to the use of different solvents: chlorinated organic solvents, hydrocarbons and their derivatives and possibly mixtures with water, which constitutes a considerable advantage of the method of the invention, which can operate under satisfactory conditions with other "hydrocarbon" type solvents, such as undecane, which may replace chlorinated solvents in the future.

With these low volatility solvents it is necessary to move away from azeotropic conditions to avoid excessive consumption of vapour, which represents another very particular advantage of the method of the present invention.

Of course, the embodiment of the invention shown in FIG. 2 may be modified and provides the basis for a certain number of variants.

For example, the arrangement of the primary condenser could be modified, being separated from the group of filters for example, the groups of filters being associated with each other and separate from the primary condenser, for example. An arrangement of this kind is used in the plant shown diagrammatically in FIG. 3.

The flexible storage tank 4 adapted in the installation described to receive the gases temporarily may be omitted from the plant if the vapour emitted is cleaned sufficiently beforehand.

Moreover, although the heat pump device has a significant advantage, in some cases it may be dispensed with for reasons of simplicity or to reduce the investment cost.

Figure 3:
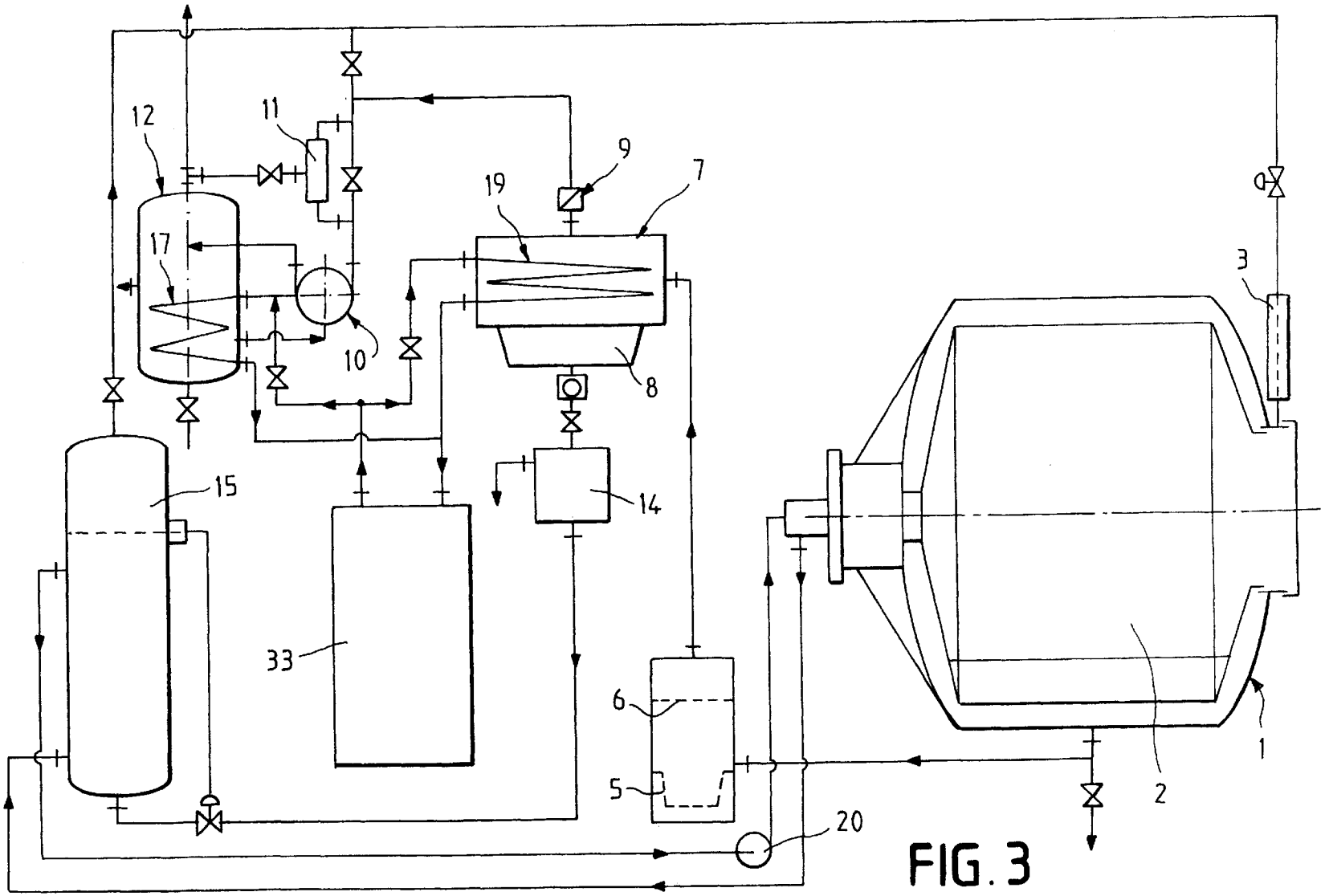
FIG. 3: another plant for implementing the method of the invention.

Accordingly, FIG. 3 is a diagrammatic representation of plant for implementing the method of the invention that does not incorporate the flexible storage tank 4 of the plant shown in FIG. 2 but which could have a device of this kind added to it, if necessary; more importantly, to reduce the investment cost, this plant does not use a heat pump.

Accordingly, the machine shown in FIG. 3 is essentially distinguished from that of FIG. 2 by the fact that the heat pump has been replaced by a low-pressure vapour generator (15) and a water cooling system (33) that operate independently of each other.

Thus in the FIG. 3 device the low-pressure steam generator (15) can be heated electrically or by a heating coil fed by a conventional steam generator operating at a pressure between $4\times10^5$ Pa and $8\times10^5$ Pa and preferably from 5 to $6\times10^5$ Pa.

This low-pressure generator can supply superheated steam directly at a temperature between 80° and 150° C., or the superheating can be done independently.

The low-pressure generator can also supply the hot water required for heating the machine to a temperature between 40° and 75° C., or the machine can be heated independently.

The low-pressure steam generator supplies superheated steam at a pressure between $0.8\times10^4$ Pa and $8\times10^4$ Pa, preferably at a pressure in the order of $5\times10^4$ Pa.

The water cooler (33) is a conventional device comprising a cooling unit adapted to supply cooling water at a temperature between 4° and 12° C., for example.

FIG. 3 represents a machine of this kind which differs essentially from that shown in FIG. 2, comprising a heat pump, in that the latter is replaced by the low-pressure steam generator (15) and the water cooler (33), which operate independently of each other. This is why the same reference numbers have been used to indicate the same devices.

EXAMPLE

A machine as shown in FIG. 3 equipped with a rotary drum having a capacity of 400 liters for cleaning 20 kg of clothes using an undecane-based solvent sold under the trademark ACTEL by Shell was used with the following results:

The clothes were first cleaned in a simple washing phase with a continuously filtered circulated solvent. Duration: 11 minutes.

Washing was followed by mechanical spinning at 450 rpm for 4 minutes, leaving between 4.2 and 4.5 kg of solvent in the clothes.

Drying was then started by simultaneously starting up the vacuum pump (10), the heating of the machine from the boiler (15) and the water cooling device (33, 17 and 19).

The injection of vapour was started when the residual pressure in the machine was below $1.5\times10^4$ Pa.

After 14 minutes drying was finished and atmospheric pressure was re-established within the machine, enabling the door to be opened and the load of clothes to be removed.

The concentration of solvent inside the machine on opening the door was much lower than the applicable standards, currently 300 ppm in Germany and in the United States in particular.

These particular operating conditions, use of vacuum and scavenging by steam, assure total safety. The atmosphere in the machine was at all times below ignition and explosion limits.

The total duration of the cleaning cycle was in the order of 30 minutes.

A similar cleaning operation, with current conventional machines using the same solvent, would require a preliminary phase of establishing an inert gas atmosphere and the total duration of the cycle would be in the order of 50 minutes.

I claim:

1. Method for cleaning fabrics or clothing in a liquid medium which comprises the steps of (a) cleaning in the presence of said liquid medium and, subsequently, (b) drying in a vacuum, each step being carried out in an enclosure having a pressure which is lowered from a first pressure at which cleaning is effected to a vacuum value between $1.5\times10^3$ Pa and $15\times10^3$ Pa at which drying is effected, steam being injected into said enclosure when the pressure therein reaches the vacuum value, the steam being supplied and introduced into said enclosure from a steam source at a pressure between $0.8\times10^4$ Pa and $8\times10^4$ Pa.

2. Method according to claim 1 characterized in that said drying step is carried out at a temperature between 30° and 55° C.

3. Method according to claim 1 characterized in that the wall of the enclosure in which the drying is carried out is heated to a temperature between 40° and 75° C. during said drying step.

4. Method according to claim 1 characterized in that said steam is superheated to a temperature between 80° and 150° C. before it is injected.

5. Method according to claim 1 characterized in that the drying step is carried out in a bivariant system enabling for a given pressure the choice of the temperature and the proportion of steam injected during said drying step.

6. Method according to claim 1 characterized in that said liquid medium is an organic solvent.

7. Method according to claim 6 characterized in that said organic solvent is perchlorethylene.

8. Method according to claim 6 characterized in that said solvent is a $C_8$ through $C_{12}$ saturated or unsaturated hydrocarbon or a derivative of such hydrocarbon, mixed or not with water.

9. Apparatus for cleaning fabrics or clothing in a liquid medium including a sealed drying enclosure comprising a rotary drum, means for establishing a vacuum between $1.5\times10^3$ and $15\times10^3$ Pa in said enclosure during drying, and means for supplying and injecting steam into said enclosure at a pressure between $0.8\times10^4$ and $8\times10^4$ Pa.

10. Apparatus in accordance with claim 9 wherein the means for establishing the vacuum comprises a water ring vacuum pump having a suction device with an air injector disposed thereon, the pump being designed to operate in a closed circuit.

11. Apparatus in accordance with claim 9 wherein the rotary drum is provided with a heating device.

12. Apparatus in accordance with claim 9 further comprising means for superheating low pressure steam prior to the steam being introduced into said rotary drum.

13. Apparatus in accordance with claim 9 further including a heat pump.

14. Apparatus in accordance with claim 13 wherein the heat pump includes a compressor, a heat generator, and cooling devices.

15. Apparatus in accordance with claim 14 wherein said heat generator furnishes (a) low pressure vapor heated by said generator before being introduced into the rotary drum, and (b) hot water circulated by the pump for heating the surface of the drum.

* * * * *